US011462378B2

(12) United States Patent
Sedeño Merchán et al.

(10) Patent No.: US 11,462,378 B2
(45) Date of Patent: Oct. 4, 2022

(54) DOUBLE-ARMATURE RELAY

(71) Applicant: Elesta GmbH Ostfildern (DE) Zweigniederlassung Bad Ragaz, Bad Ragaz (CH)

(72) Inventors: Juan Cristóbal Sedeño Merchán, Wädenswil (CH); Antonino Spataro, Vilters-Wangs (CH); Marco Giger, Vilters-Wangs (CH); Attila György, Malans (CH); Herbert Willi, Heiligkreuz (CH)

(73) Assignee: Elesta GmbH Ostfildern (DE) Zweigniederlassung Bad Ragaz

( * ) Notice: Subject to any disclaimer, the term of this patent is extended or adjusted under 35 U.S.C. 154(b) by 70 days.

(21) Appl. No.: 16/942,660

(22) Filed: Jul. 29, 2020

(65) Prior Publication Data

US 2021/0035759 A1 Feb. 4, 2021

(30) Foreign Application Priority Data

Jul. 30, 2019 (CH) ..... 00968/19

(51) Int. Cl.
*H01H 50/36* (2006.01)
*H01H 50/54* (2006.01)
(Continued)

(52) U.S. Cl.
CPC ..... *H01H 50/36* (2013.01); *H01H 50/24* (2013.01); *H01H 50/443* (2013.01); *H01H 50/546* (2013.01)

(58) Field of Classification Search
CPC .. H01H 50/24; H01H 2300/024; H01H 3/001; H01H 50/043; H01H 50/30;
(Continued)

(56) References Cited

U.S. PATENT DOCUMENTS 4,689,587 A * 8/1987 Schroeder ..... H01H 50/548 335/121
4,833,435 A * 5/1989 Ohara ..... H01H 51/20 335/265
(Continued)

FOREIGN PATENT DOCUMENTS

JP 2005050655 A * 2/2005

OTHER PUBLICATIONS

Machine translation of JP2005-50655 (Year: 2005).*

*Primary Examiner* — Bernard Rojas
(74) *Attorney, Agent, or Firm* — Morriss O'Bryant Compagni Cannon, PLLC

(57) ABSTRACT

An electromagnetic double-armature relay with an excitation coil comprises a first yoke and a second yoke, which are arranged on the excitation coil. The first leg of the first yoke serves as a support for a first armature and the first leg of the second yoke serves as a support for a second armature. The double-armature relay has a first comb which cooperates with the first armature, and a second comb cooperates with the second armature. In addition, the double-armature relay has at least two contact bridges, each of which is detachably arranged with a first end in the first comb and the second end in the second comb and comprises two contact rivets oriented in opposite directions, and fixed contacts which are arranged opposite the contact rivets of the contact bridge. The arrangement of the two yokes and armatures are such that the two combs perform opposing translational movements.

17 Claims, 5 Drawing Sheets

(51) Int. Cl.
*H01H 50/44* (2006.01)
*H01H 50/24* (2006.01)

(58) Field of Classification Search
CPC .... H01H 50/36; H01H 50/443; H01H 50/546; H01H 50/548; H01H 50/642; H01H 51/20
USPC ..... 335/119, 124, 126–131, 186, 189
See application file for complete search history.

(56) References Cited

U.S. PATENT DOCUMENTS

| | | | | |
|---|---|---|---|---|
| 5,734,308 | A * | 3/1998 | Dittmann | H01H 50/36 335/78 |
| 6,538,540 | B2 * | 3/2003 | Oberndorfer | H01H 51/20 335/267 |
| 7,504,915 | B2 * | 3/2009 | Takayama | H01H 50/642 335/78 |
| 7,633,363 | B2 * | 12/2009 | Fausch | H01H 50/026 335/124 |
| 8,810,343 | B2 * | 8/2014 | Kellner | H01H 50/641 335/106 |
| 9,093,239 | B2 * | 7/2015 | Kato | H01H 50/54 |
| 2012/0182097 | A1 * | 7/2012 | Moeller | H01H 51/2272 335/71 |
| 2013/0033345 | A1 * | 2/2013 | Hirao | H01H 50/642 335/185 |

* cited by examiner

DOUBLE-ARMATURE RELAY

CROSS-REFERENCE TO RELATED APPLICATIONS

The present application claims priority to Swiss Patent Application No. 00968/19 filed on Jul. 30, 2019, the entirety of which is incorporated by this reference.

TECHNICAL FIELD OF THE INVENTION

The invention relates to double-armature relays.

BACKGROUND OF THE INVENTION

Electromagnetic double-armature relays are well-known in the prior art. DE10035173C1 discloses a double-armature relay, in which, by energizing the coil, both armatures pivot about a rotation axis perpendicular to the coil axis. When two armatures are operated by one coil, a compact design of the relay is achieved, on the one hand, and the power loss of the coil is reduced, on the other hand. From commercially available relays it is also known that two contact rivets are brought together by the movement of the armature and thereby establish an electrical contact. Said contact should be broken when the energization of the coil is stopped.

Two contact rivets can accidentally come into contact and establish a contact. In addition, the contact rivets could also be put in this state and not moved back. An example is the welding of two contact rivets. Since relays are used in different areas, they are exposed to different conditions. Depending on the application, the relays experience vibrations as well as constant or individual impacts. Especially in security applications, it is essential that a relay displays a great reliability in this regard.

Advantages

The present invention provides a double-armature relay which combines a compact design with a resistance in its functionality to vibrations or impacts and which can provide feedback when an error occurs.

SUMMARY OF THE INVENTION

The advantages of the invention are achieved by providing an electromagnetic double-armature relay as set forth in the independent claims. Further developments and/or advantageous embodiment variants are the subject of the dependent claims.

The invention relates to an electromagnetic double-armature relay, which comprises an excitation coil having a longitudinal axis with a first and a second end. Furthermore, the double-armature relay comprises a first yoke that is arranged at the first end of the excitation coil and a second yoke that is arranged at the second end of the excitation coil, the yoke having two legs, the first of which is essentially parallel and the second is at an angle to the longitudinal axis of the excitation coil. The first leg of the first yoke serves as a support for a first armature and the first leg of the second yoke serves as a support for a second armature. The second leg in turn serves as a pole face for the second armature, and the second leg of the second yoke serves as a pole face for the first armature. The first armature is pivotably arranged on the first leg of the first yoke by means of a first holding means. Analogously, the second armature is pivotably arranged on the first leg of the second yoke by means of a second holding means. The double-armature relay has a first comb which cooperates with the first armature and can be moved back and forth essentially perpendicular to the longitudinal axis of the excitation coil. A second comb cooperates with the second armature and can also be moved back and forth essentially perpendicular to the longitudinal axis of the excitation coil, the first and the second comb being arranged opposite each other on the pole faces of the excitation coil. In addition, the double-armature relay has at least two contact bridges, each of which is detachably arranged with a first end in the first comb and the second end in the second comb and comprises two contact rivets oriented in opposite directions, and fixed contacts which are arranged opposite the contact rivets of the contact bridge. Wherein two fixed contacts in a de-energized rest position are in contact with the contact rivets of a first contact bridge and the remaining fixed contacts coming into contact with their opposing contact rivets of the remaining contact bridges by energizing the excitation coil.

The invention is characterized in that the two yokes and armatures are arranged in such a way that the two combs perform opposing translational movements.

The advantage of the invention results from the characteristic feature. The opposing translational movement of the two combs prevents the relay from malfunctioning when a force is exerted on the relay from outside. This force may occur in the form of a blow or also in the form of vibrations.

The two contact rivets on each contact bridge are oriented in the opposite direction. The electrical circuit of a contact bridge is closed when both contacts of the contact bridge are closed. This in turn causes the deflection of both ends of the contact bridge in opposite directions. This means that a closed circuit of a contact bridge is only achieved if the combs move in opposite directions. If the combs move unintentionally in the same direction, no electrical circuit of any contact bridge is closed. An unintentional movement of the combs can be triggered by an impact, a blow or vibrations at the double-armature relay. The relay according to the invention, due to the above-mentioned features, features a resistance in its functionality with respect to external factors such as impact, blow or vibrations.

The inventive structure of the relay enables also a serial arrangement of multiple contact bridges. For a relay with a larger number of contact bridges, this in turn leads to the most compact possible design.

The advantageous embodiment variants listed below lead, alone or in combination with one another, to further improvements of the double-armature relay.

In another embodiment, the two legs of the yokes are arranged on opposite sides of the excitation coil. This is one way of arranging the yokes so that the combs perform a translational movement. The advantage of this arrangement is that it leads to a compact design, that is to say a small space requirement and, in particular, to a low height of the entire double-armature relay.

In a further embodiment, the yoke is J-shaped and the first leg is the longer of the two legs. The J-shape automatically adjusts the length of the two legs to be different. The advantage of a longer first leg results from the larger distance on the leg for selecting the support surface of the armature. In contrast, the length of the leg serving as the pole face does not provide any constructive or technical advantages, which is why it is also made shorter.

Advantageously, the base of the yoke is fixed to the end face of a core running through the excitation coil. The core amplifies the electromagnetic effect of a coil and is common in today's applications. Attaching the yokes to the core of the coil saves space in the direction of the coil axis. The expansion of the double-armature relay in the direction of the coil axis is thus kept to a minimum. At the same time, attaching the yoke to the face of the excitation coil in conjunction with the core allows the magnetic field to be diverted onto the short leg of the yoke, which forms the pole face for the armature.

In a further embodiment, the first leg of the yoke has a recess at a short distance from the end, and the armature at its center of gravity has a curvature which comes into engagement with the recess of the yoke. Both the recess at the first leg of the yoke and the curvature of the armature serve to carry out a pivoting movement of the armature. By placing the curvature at the center of gravity of the armature, the armature is supported at its center of gravity and does not move out of its rest position when a force is exerted on the relay from outside. In order to set the armature in motion, a force must be exerted on a position of the armature which is offset from its center of gravity. This would create a momentum around the center of gravity of the armature, which would cause the armature to pivot. The execution of a pivotal movement is facilitated by the shape of a curvature in the armature.

In the de-energized rest position, the armature extends essentially parallel to the longitudinal axis of the excitation coil. The extension of the double-armature relay in the direction perpendicular to the coil axis is thus kept as small as possible, which in turn leads to the most compact design of the double-armature relay possible.

Advantageously, the armature is approximately the same length as the excitation coil. As a result, the maximum use of the space in the double-armature relay in the direction of the coil axis is achieved. In addition, the pivot angle becomes smaller as the length of the armature increases. This in turn leads to a smaller friction surface of the armature and thus to less wear at the armature due to the pivoting movement.

In another embodiment, the double-armature relay comprises a housing with a lower housing part and a cover. The lower housing part serves to attach the components described above and to assign a fixed association of these components. This constitutes a prerequisite of a possible serial production of a double-armature relay according to the invention. The cover, in turn, provides protection to components attached to the lower housing part and does not permit any object to enter nor to exit the housing.

Advantageously, the contact bridge comprises a spring sheet. The contact bridges serve the purpose to return the combs back to their original position. This occurs when the energization of the excitation coil is stopped. The spring sheet is an ideal solution for this task, since with its small weight it does not oppose the deflection with any great force, but with its spring force it can move the comb into its original position. If the contact bridge is formed by a spring sheet, the spring sheet performs a deflection at one end each due to the two combs. These deflections are independent of one another, so that one end of the spring sheet is not influenced by what is happening at the other end. It is therefore easily conceivable that a contact bridge comprises two spring sheets. In such a case, one spring sheet in each case would be responsible for the deflection of one comb at a time. In addition, the two spring sheets would have electrical contact with one another so that they would continue to perform the task of the contact bridge.

In a further embodiment, the contact bridge has a tap approximately in its center, which is connected to a connecting pin attached under the lower housing part. This makes it possible to read out the electrical impulse in the center of the contact bridge. In the case of a contact bridge that does not have a closed electrical circuit, the position of the contacts can be determined using the tap in the center.

Advantageously, the excitation coil with the yokes is positioned and aligned on the lower housing part by means of two depressions that are arranged opposite one another. The presence of depressions, with which the excitation coil is aligned, results in a clear geometric association of the excitation coil within the housing. At the same time, the depressions ensure increased stability of the excitation coil within the housing.

Each contact bridge may be sandwiched between two profile elements attached in the center of the lower housing part. The profile elements attached in the center of the lower housing part hold the contact bridges in place. In this way, they also provide a certain space for the contact bridge in the lower housing part. Securing the contact bridge by sandwiching makes it easy to remove and install a contact bridge.

In a further embodiment, each contact bridge is shielded from the adjacent contact springs or from the excitation coil by means of a partition, and the partition comprises one or two profile elements for sandwiching the contact bridge. The shielding of the contact bridges from one another prevents a contact bridge from being influenced by an adjacent contact bridge or its parts. This would be possible, for example, if a contact bridge breaks.

The fixed contacts may be attached to the partitions. This ensures an increased stability of the mounting of the fixed contacts. At the same time, the manufacture of the relay is simplified, which in turn can result in cost reduction and time savings.

Advantageously, the lower housing part comprises the partitions with the fixed contacts. The presence of the partitions on the lower housing part facilitates the correct association of the components to be attached to the lower housing part. The partitions, which generally run parallel to the coil axis, increase the rigidity of the lower housing part, especially in the direction of the coil axis.

In a further embodiment, the angle of the pole faces can be changed with respect to the longitudinal axis of the excitation coil. The angle of the pole faces determines the distance from the pole face to the armature as well as the point of impact of the armature on the pole face. The armature should strike the pole surface as far to outside as possible, since due to the lever principle, the momentum generated is the highest at the pivot point of the armature. However, this applies to the situation when the armature rests on the pole face. The larger the momentum at the center of gravity of the armature, the greater is the readiness of the armature to remain in the deflected position. The distance from the pole face to the armature in turn determines the force with which the armature is attracted to the pole face. The shorter the distance between the pole face and the armature, the greater is the magnetic force that the pole face exerts on the armature. The amplitude of this force in turn determines the speed of the pivoting movement of the armature. The distance between the pole face and the armature defines also the pull-in/drop out voltages. These voltages determine the voltage at which the armature moves to the pole face or away from the pole face. Thus, the pull-in/drop out voltages can be set by the distance of the pole face to the armature, which have a significant relevance for the characteristics of the operation of a relay.

In another embodiment, guides for the combs are provided on the lower housing part, which are covered by the cover in the closed state. Guides facilitate the positioning of the combs and enable them to glide with low friction during their movements.

Each fixed contact may be connected to a connection pin attached below the housing. The connection pin is used to transmit the electrical impulses from the relay to, for example, a connected device. Since the contact bridges run between two fixed contacts, they establish a closed electrical circuit from one fixed contact to the other fixed contact when the excitation coil is energized. By connecting each fixed contact to a connection pin, all electrical impulses introduced into the relay are also carried out again as long as the respective contact bridge has closed the contacts. Since the cover is attached to the top of the lower housing part, the bottom of the lower housing part does not influence the opening and closing of the cover.

The optional features mentioned can be implemented in any combination, provided they are not mutually exclusive. Particularly where ranges are given, further ranges result from combinations of the minima and maxima mentioned in the ranges.

BRIEF DESCRIPTION OF THE FIGURES

Further advantages and features of the invention result from the following description of exemplary embodiments of the invention with reference to schematic representations. In a representation that is not to scale.

DETAILED DESCRIPTION OF THE FIGURES

Figure 1:
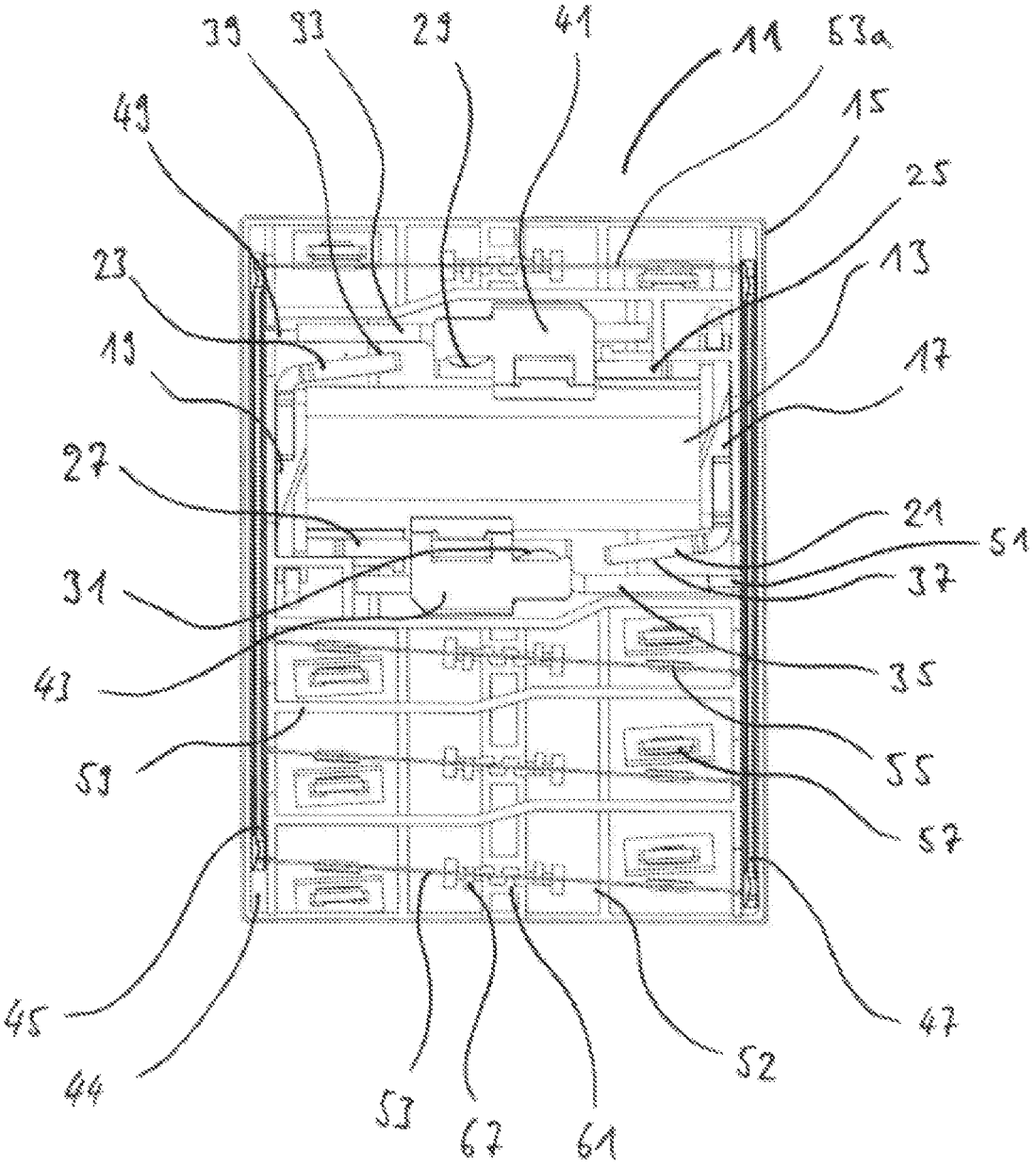
FIG. 1: shows a top view of a double-armature relay according to the invention with 4 contact bridges.

In the following, the same reference numerals designate the same or functionally identical elements (in different figures). An additional apostrophe can be used to differentiate between elements of the same type or with the same function or with a similar function in a further embodiment.

Figure 2:
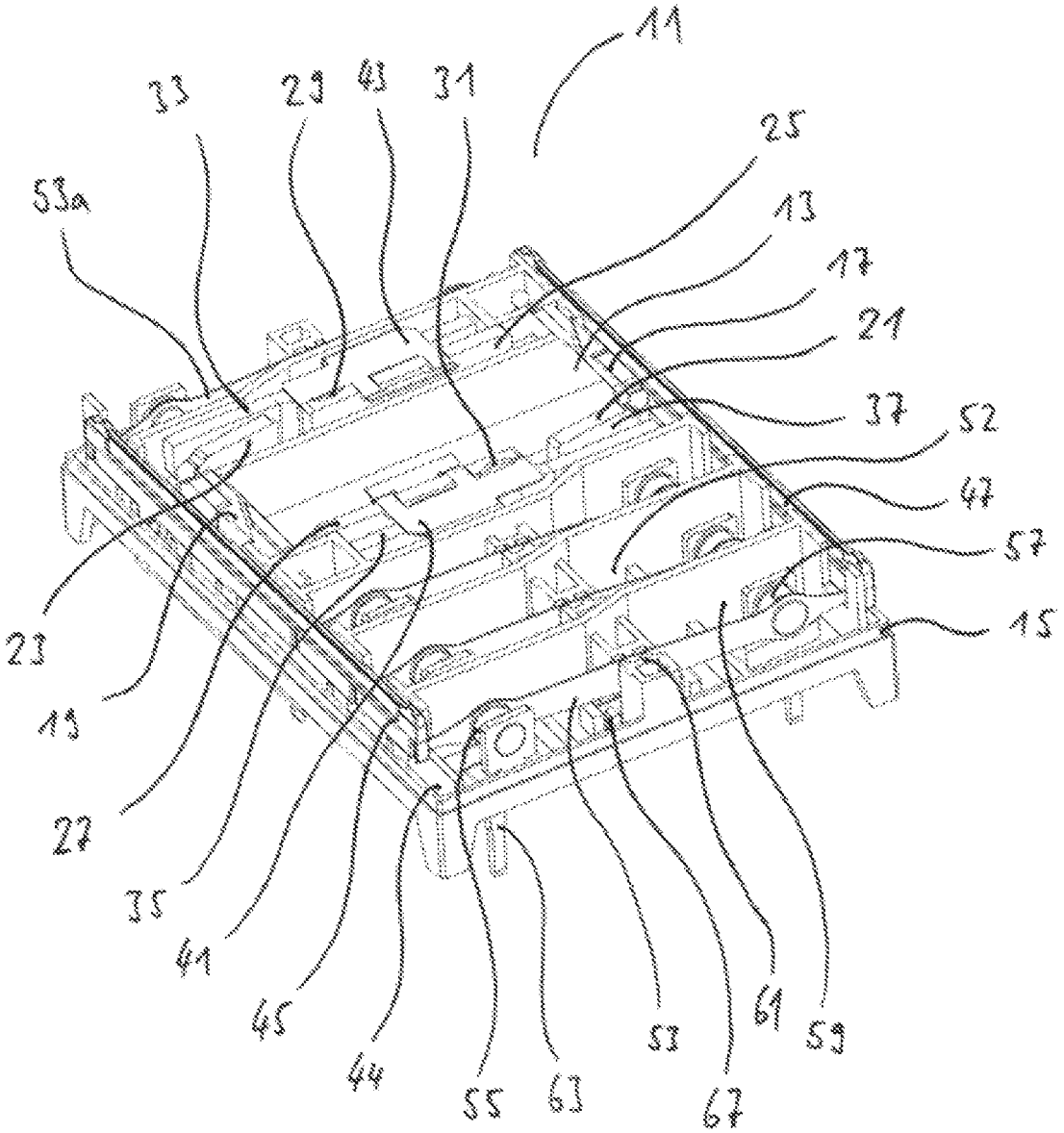
FIG. 2: shows a three-dimensional representation of the same double-armature relay according to the invention from FIG. 1.

FIGS. 1 and 2 show an electromagnetic relay 11 with an excitation coil 13, the coil axis of which extends in the longitudinal direction of excitation coil 13. The two ends of the excitation coil form the pole faces. FIG. 1 shows a top view of an electromagnetic relay according to the invention. The electromagnetic relay comprises a housing which consists of a lower part 15 and a cover (not shown in the figure) which can be placed thereon. Lower housing part 15 accommodates all components relevant to the function of the electromagnetic relay. At the same time, lower housing part 15 has a rectangular shape. Excitation coil 13 is arranged such that its axis comes to rest perpendicular to the longitudinal sides of lower housing part 15. The excitation coil is arranged offset from the center of the lower housing portion 15, so that the distance from excitation coil 13 to a width edge of lower housing part 15 compared to that to the other broadside edge is about twice as long. Excitation coil 13 extends so far in its longitudinal direction that at both ends an equally large gap to the longitudinal edges of lower housing part 15 forms. The cross section of the excitation coil 13 can be either rectangular or round. The diameter of the cross section, regardless of the shape, is approximately one fifth of the length of excitation coil 13. In excitation coil 13, a core (not shown in the drawing) made of iron is attached, which fills the interior of excitation coil 13 from one end to the other end.

J-shaped yokes 17,19 are attached to both pole faces of the excitation coil. First yoke 17 is arranged rotationally symmetrically with respect to second yoke 19, wherein the axis of rotation comes to rest perpendicular to the lower housing part in the center of the excitation coil. Yoke 17,19 comprises a short leg 21,23, a long leg 25,27, and a base. The base of the yoke 17,19 represents the connecting piece between short leg 21,23 and long leg 25,27. Each yoke 17,19 is attached at its base to one end of the core, which extends through excitation coil 13, so that its legs are directed towards excitation coil 13. The long leg extends parallel to the coil axis and beyond the center of the coil length. At a short distance from its end, the leg has a round recess on its side opposite to excitation coil 13. This recess comprises a receiving surface 29,31. Said surface serves to accommodate armature 33,35. Armature 33,35 has a curvature approximately in its center, which comes to rest on receiving surface 29,31 of long leg 25,27. Thus, armature 33,35 is pivotable on receiving surface 29,31 and is restricted in its pivotal movement in the direction of pole face 37,39 by said face. In the rest position when no current flows through excitation coil 13, armature 33,35 is arranged essentially parallel to excitation coil 13. A holding means 41,43 ensures a non-slip arrangement of armature 33,35 by pressing said armature onto receiving surface 29,31 without affecting its pivoting. Armature 33,35 has an arm 49,51 as an extension of its longitudinal direction. This arm 49,51 is arranged on that half, which comes to rest on pole face 37,39 when excitation coil 13 is energized. After placing armature 33,35 on receiving surface 29,31, arm 49,51 of the armature tops excitation coil 13 together with yoke 17,19.

The arm 49,51 of the armature comes into engagement with a comb 45,47. Said comb extends perpendicular to the coil axis of excitation coil 13, in each case on both pole faces of excitation coil 13 on the edge of lower housing part 15. On lower housing part 15, guides 44 are attached along both longitudinal edges, on which the two combs 45,47 come to rest. A cutout for arm 49,51 of the armature is attached in comb 45,47. When the armature pivots, the arm of the armature pushes comb 45, 47 and causes its translational movement. Due to the rotationally symmetrical arrangement of yokes 17,19 and thus also of armature 33,35 around excitation coil 13, both combs 45,47 move in opposite directions. Comb 45,47 has a length, which is smaller than the longitudinal side of the lower housing part 15, so that upon movement of comb 45,47, said comb does not project beyond lower housing part 15.

The comb has further cutouts in its longitudinal direction. Said cutouts are attached to accommodate contact bridge 52. Contact bridges 52 run essentially in the direction of the coil axis from one longitudinal edge to the opposite longitudinal edge of lower housing part 15. A contact bridge 52*a* is arranged on that side of excitation coil 13, which is defined by the shorter distance from excitation coil 13 to the broadside edge of lower housing part 15. On the opposite side of excitation coil 13 there are three further contact bridges 52*b*. In the embodiments described here and shown in the figures, each contact bridge 52 is formed by one contact spring 53 in each case.

Each contact spring 53 has two contact rivets 55. Said contact rivets 55 are attached to the two outer areas of contact springs 53. The two contact rivets 55 on contact spring 53 are always attached on different sides and point in opposite directions. A fixed contact 57 is provided opposite to each contact rivet 55 of a contact spring 53. Said fixed contact 57 comprises a contact which is immovably attached to lower housing part 15. In a de-energized rest position of excitation coil 13 and armatures 33,35, the two contact rivets 55 of contact spring 53*a* which is insulated from remaining contact springs 53 by excitation coil 13, are in the closed state with oppositely attached fixed contacts 57. In this situation, the contacts of the remaining contact springs 53 are at a distance from the respective fixed contacts 57 and are therefore in the open state.

When energizing excitation coil 13, armatures 33,35 are pivoted at the same time in the direction of pole face 37,39 and move laterally arranged combs 45,47 along. Combs 45,47 in turn deflect engaging contact springs 53 in the same direction. As a result, open contacts 55 are closed and closed contacts 55 are opened. In proper operation of excitation coil 13, armatures 33,35 move approximately at the same time. As a result, contacts 55 of a contact spring 53 are either both in a closed state or both in an open state. When a single armature 33,35 or comb 45,47 moves, there is no closed circuit at any contact spring 53, since all contact springs 53 have at least one open contact. When energizing the excitation coil, it may also be desirable for the armatures to move at a slightly different time. As a result, one side of the contact springs is brought into contact with the fixed contacts while the current flow through the contact spring is still interrupted. This prevents the risk of fusing these contacts together.

The center of contact spring 53 is arranged at lower housing part 15. Upon deflection of comb 45,47 and contact springs 53 arranged therein, contact springs 53 bend from their center in the direction of movement of comb 45,47. The rigidity of contact springs 53 causes them to assume their original straight shape when excitation coil 13 is not energized. In doing so, contact spring 53 pulls comb 45,47 together with armature 33,35 also back into their original position.

Partitions 59 are attached to lower housing part 15 between contact springs 53 themselves and excitation coil 13. Said partitions extend from the trace of one comb 45,47 to the trace of the other comb. Profile elements 61 are attached in the center of these partitions 59, so that only just a gap remains between two opposite profile elements 61. Profile elements 61 have two bulges at those places where the opposite profile element has a notch. The gap is defined by the distance between the tips of the bulges from two opposing profile elements. Contact spring 53 is arranged in this gap.

Figure 3:
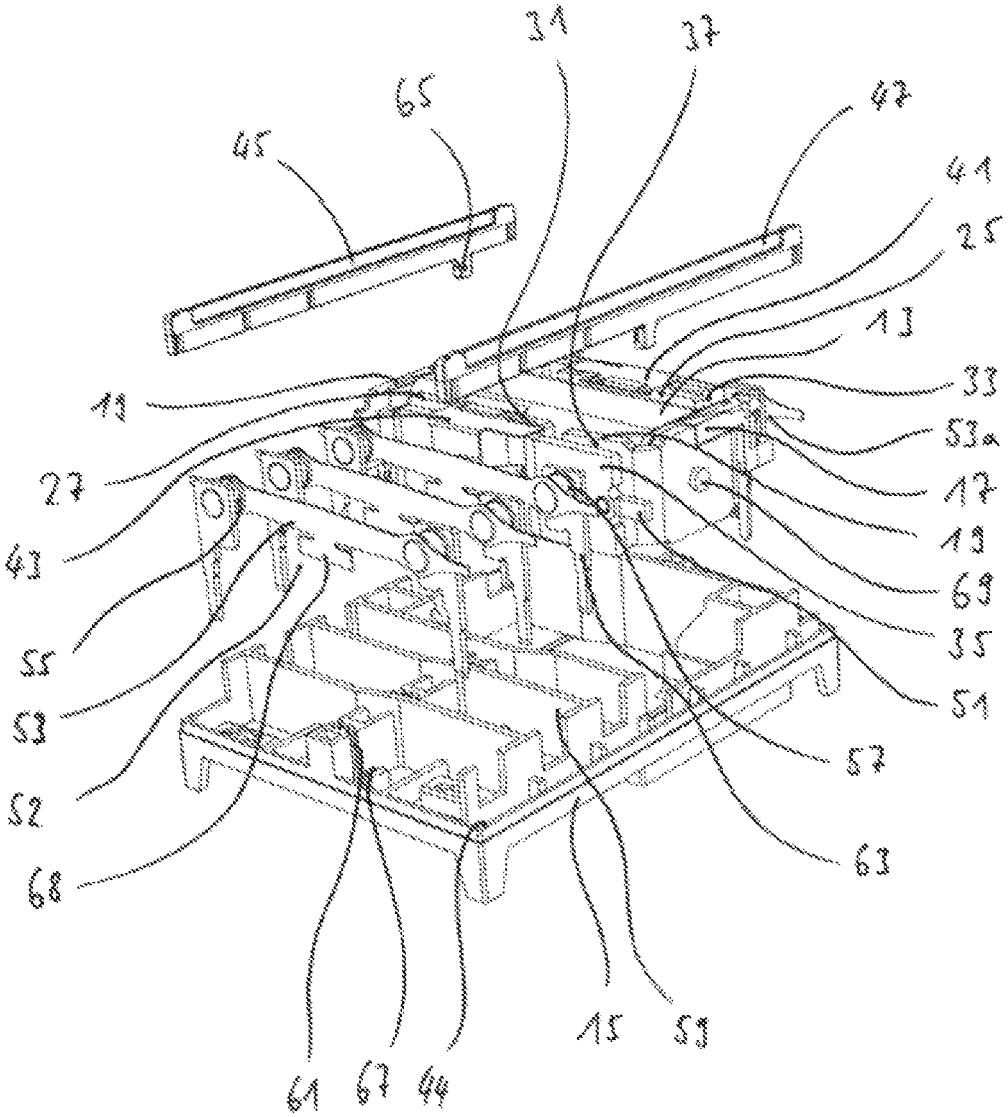
FIG. 3: shows an exploded view of a double-armature relay.

FIG. 3 shows an exploded view of a possible embodiment of a double-armature relay 11. Without contact springs 53 depicted between partitions 59, their geometry is clearly visible. Profile elements 61 attached to partitions 59 are, as already described above, placed in the center of partitions 59. Fixed contacts 57 are attached to a connection pin 63, the size of which can be seen in this illustration. Connection pin 63 is pushed through from the top of lower housing part 15 through lower housing part 15. As described above, fixed contact 57 is located at the top of lower housing part 15. The area of connection pin 63, which is responsible for the transmission of the electrical power, is arranged at the bottom of lower housing part 15.

Comb 45,47 has recesses in its longitudinal direction, equal to the number of contact springs 53 in the relay. Furthermore, a nib 65 is attached to its bottom. In the installed state, said nib comes to rest next to the arm of armature 49,51 on the side to which the arm of the armature moves upon the pivoting movement of armature 33,35.

A blocking body 67 is attached next to each profile element 61 on lower housing part 15. Said blocking body has an approximately cube-shaped structure and has an edge length of a quarter of the height of partitions 59. This blocking body 67 is arranged on that side of contact spring 53 to which contact spring 53 can bend. As shown in FIG. 3, contact springs 53 have a further element at their lower edge. A tongue-shaped tab 68 extends in both longitudinal directions of contact spring 53. This tab 68 protrudes from the center in both longitudinal directions up to respective blocking body 67, so that in the installed state contact spring 53 is in contact with blocking body 67. This prevents tab 68 from also bending when contact spring 53 bends.

Figure 4:
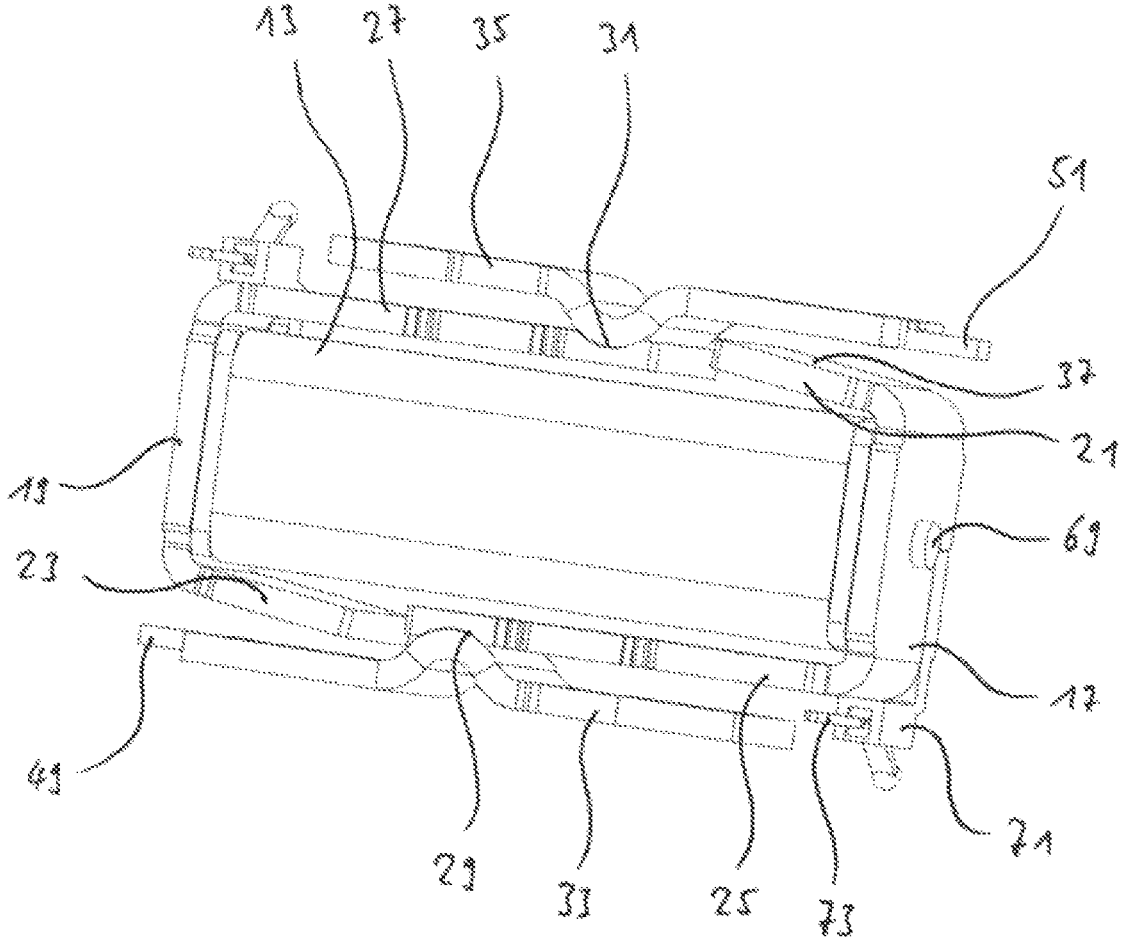
FIG. 4: shows a three-dimensional view of an excitation coil with two yokes and two armatures.
Figure 5:
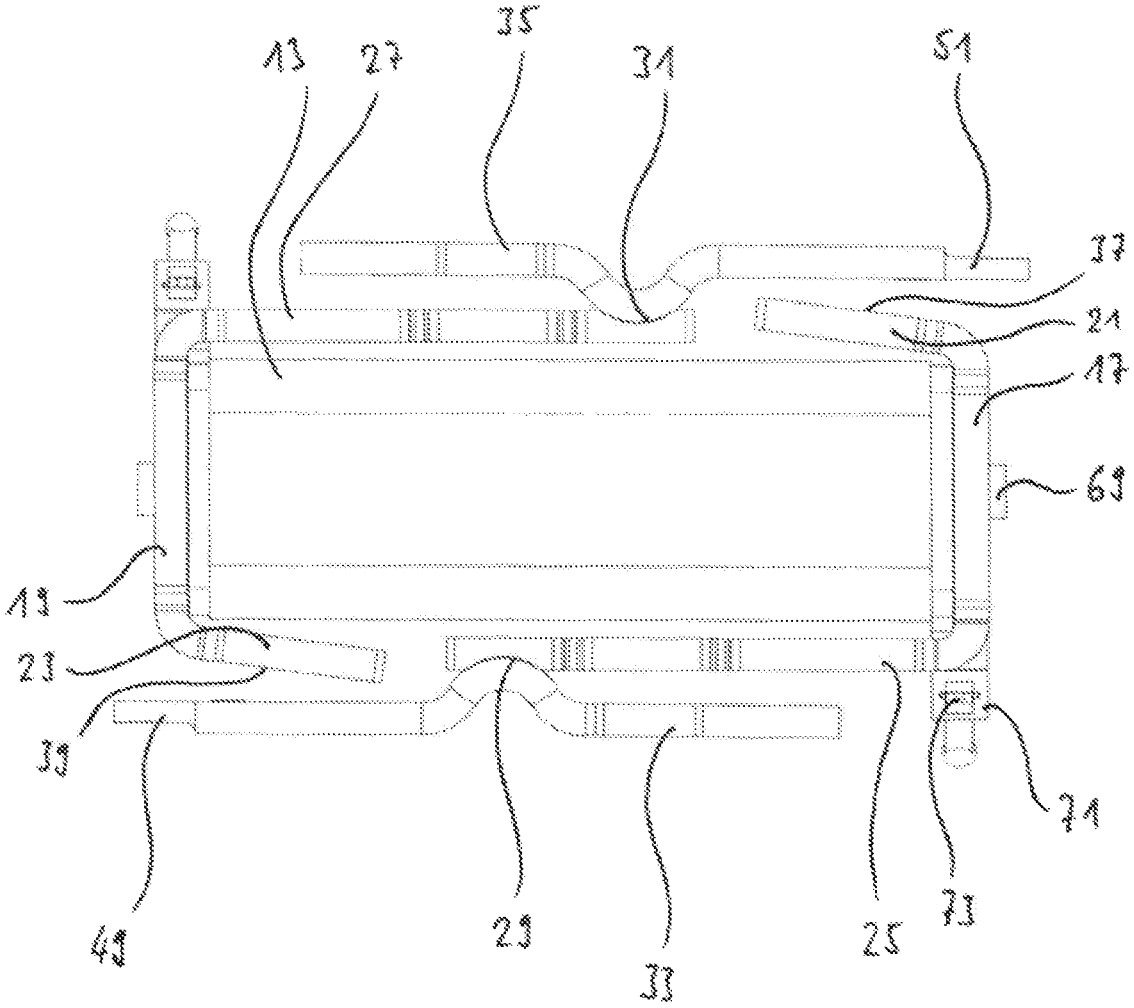
FIG. 5: shows a top view of the excitation coil of FIG. 4.

FIGS. 4 and 5 show excitation coil 13 with two yokes 17,19 and armatures 33,35. The illustration shows the state of the de-energized rest position of coil 13 and armatures 33, 35. Yokes 17,19 are attached to the core (not shown here) of excitation coil 13 using a rivet 69. Short leg 21,23, which comprises pole face 37,39, is at an angle to the coil axis. This angle defines the distance of pole face 37,39 to armature 33,35 and also the place on pole face 37,39 at which armature 33,35 will strike.

On both pole faces of excitation coil 13, there are two pin receptor sockets 71 offset perpendicular to the coil axis. A pin 73 is arranged in each of said pin receptor sockets, which establishes the connection from an electrical control circuit to excitation coil 13. The beginning and end of the wire of excitation coil 13 are attached to these two pins 73, the beginning and end of the wire not being shown in FIGS. 4 and 5. Pin 73 has a greater length than the height of excitation coil 13, so that it protrudes from the bottom of the lower housing part 15 in the installed state of excitation coil 13.

While specific embodiments have been described above, it is obvious that different combinations of the shown design options can be used insofar as the design options are not mutually exclusive.

The invention claimed is:

1. An electromagnetic double-armature relay, comprising:

an excitation coil having a longitudinal axis, a first and a second end;

a first yoke arranged at the first end of the excitation coil and a second yoke arranged at the second end of the excitation coil, each of the first and second yolks having two legs, the first of which is essentially parallel and the second is at an angle to the longitudinal axis of the excitation coil, the first leg of the first yoke serving as a support for a first armature and the first leg of the second yoke serving as a support for a second armature, the second leg of the first yoke serving as a pole face for the second armature, and the second leg of the second yoke serving as a pole face for the first armature;

the first armature pivotably arranged on the first leg of the first yoke by a first holding device;

the second armature pivotably arranged on the first leg of the second yoke by a second holding device;

a first comb cooperates with the first armature and can be moved back and forth essentially perpendicular to the longitudinal axis of the excitation coil;

a second comb cooperates with the second armature and can also be moved back and forth essentially perpendicular to the longitudinal axis of the excitation coil, the first and the second combs being arranged opposite each other on opposite ends of the excitation coil;

at least two contact bridges, each of which is detachably arranged with a first end in the first comb and a second end in the second comb and each of which comprises two contact rivets oriented in opposite directions; and a plurality of fixed contacts arranged opposite the contact rivets of the at least two contact bridges, two fixed contacts in a de-energized rest position in contact with the contact rivets of a first contact bridge and remaining fixed contacts coming into contact with respective opposing contact rivets of remaining contact bridges by energizing the excitation coil, the first and second yokes and the first and second armatures arranged so that the first and second combs perform opposing translational movements.

2. The relay according to claim 1, wherein the two legs of the first yoke and the two legs of the second yoke are arranged on opposite sides of the excitation coil.

3. The relay according to claim 1, wherein each of the first and second yokes is J-shaped0 and the first leg is the longer of the two legs thereof.

4. The relay according to claim 1, wherein a base of each of the first and second yokes is fixed to an end face of a core running through the excitation coil.

5. The relay according to claim 1, wherein the first leg of each of the first and second yokes has a recess at a short distance from an end, and the each of the first and second armatures at its center of gravity has a curvature that comes into engagement with the recess of a respective one of the first and second yokes.

6. The relay according to claim 1, wherein the each of the first and second armatures in the de-energized rest position extends essentially parallel to the longitudinal axis of the excitation coil.

7. The relay according to claim 1, wherein each of the first and second armatures is approximately the same length as the excitation coil.

8. The relay according to claim 1, further comprising a housing with a lower housing part and a cover.

9. The relay according to claim 8, wherein each of the at least two contact bridges has a tap approximately in its center, which is connected to a connection pin attached under the lower housing part.

10. The relay according to claim 8, wherein the excitation coil with the first and second yokes is positioned and aligned on the lower housing part by two depressions that are arranged opposite one another.

11. The relay according to any claim 8, wherein each of the at least two contact bridges is sandwiched between two profile elements attached in the center of the lower housing part.

12. The relay according to 8, wherein each of the at least two contact bridges is shielded from adjacent contact bridges or from the excitation coil by a partition, the partition comprising one or two profile elements for sandwiching a respective contact bridge.

13. The relay according to claim 12, wherein the plurality of fixed contacts are attached to the partition.

14. The relay according to claim 12, wherein the lower housing part comprises the partitions with the plurality of fixed contacts.

15. The relay according to claim 8, further comprising guides for the first and second combs on the lower housing part and, the guides covered by the cover in a closed state.

16. The relay according to claim 8, wherein each of the plurality of fixed contacts is connected to a connection pin attached below the housing.

17. The relay according to claim 1, wherein each of the at least two contact bridges comprises a spring sheet.

* * * * *